US007128015B1

(12) United States Patent
Rogerson

(10) Patent No.: US 7,128,015 B1
(45) Date of Patent: Oct. 31, 2006

(54) DOCK FLOATATION SYSTEM

(76) Inventor: L. Keith Rogerson, #9 Fourth Ave., Isle of Palms, SC (US) 29451

( * ) Notice: Subject to any disclaimer, the term of this patent is extended or adjusted under 35 U.S.C. 154(b) by 0 days.

(21) Appl. No.: 11/014,644

(22) Filed: Dec. 16, 2004

(51) Int. Cl.
*B63B 35/44* (2006.01)
*B63B 3/00* (2006.01)

(52) U.S. Cl. ..... 114/266; 114/263

(58) Field of Classification Search ..... 114/261, 114/263, 266, 267
See application file for complete search history.

(56) References Cited

U.S. PATENT DOCUMENTS 5,460,114 A * 10/1995 McMillan ..... 114/267
6,651,578 B1 * 11/2003 Gorman ..... 114/267

* cited by examiner

*Primary Examiner*—Jesús D. Sotelo
(74) *Attorney, Agent, or Firm*—Dority & Manning, PA

(57) ABSTRACT

An under dock floatation system includes a float having a shape-fit projection for nesting against a concrete dock to rehabilitate a degraded free board of the dock and/or to increase a weight bearing capacity of the dock.

20 Claims, 6 Drawing Sheets

DOCK FLOATATION SYSTEM

FIELD OF THE INVENTION

This invention relates to a floatation system for a dock. More specifically, the dock floatation system restores degraded freeboard of the dock and/or increases a load-bearing capacity of the dock.

BACKGROUND OF THE INVENTION

Marinas generally provide docks extending over a body of water to provide walkways for access to boats tied to the docks. A dock can be an expansive system extending in multiple directions to accommodate various boats.

The typical dock utilizes pile glides to move up and down pilings relative to a water surface in response to tidal or wave action. As the dock moves up and down, the dock exhibits a substantially constant vertical distance from its walkway surface to the water surface. This vertical distance is known as freeboard.

Depending on dock size and a load-bearing capacity of the dock, the freeboard of the dock will be from six to thirty-six inches above the water surface. The freeboard should remain constant relative to the water surface, but over time the conventional dock can deteriorate and begin to sink; i.e., lose freeboard.

Due to the extensive, interlinked structure of some dock systems, repairing or replacing all or sections of the dock is no trivial matter. For instance, a ten-foot by four-foot by four-foot section of a concrete dock system may weigh up to ten thousand pounds. In addition to the physical challenge of removing and replacing such a section, the scrap section ultimately adds to landfill waste, which can take years to decompose.

Another drawback with the conventional dock becomes evident when an additional structure is added to the dock. If the additional structure is sufficiently heavy, the structure can exceed the load-bearing capacity of the dock in a vicinity of the added structure, which causes the dock to twist and create an uneven walkway in the vicinity of the added structure. In other words, the freeboard in that vicinity is overcome by the added weight. Thus, the load-bearing capacity of the portion of the dock bearing the additional structure must be increased to recoup the freeboard and level that portion with a remainder of the dock.

One attempt to correct degraded freeboard or to increase load-bearing capacity has included strapping a floatable device under the dock and extending the straps over the top surface of the dock. However, the straps typically connect to the floatable device with metal clamps, bolts and the like to hold the floatable device under the dock. Such metallic devices are subject to degradation in salt or brackish water, which eventually rust and allow the floatable device to break away. Moreover, the straps extending over the top surface of the dock pose a tripping hazard.

Another attempt to solve loss of dock freeboard includes placing an inflatable device under the dock and inflating the device; however, the inflatable device is typically not secured to the dock and any strong current or propeller wash ("prop wash") can blow the inflatable device from under the dock.

Another remedy to regain freeboard includes attaching new wooden structures to the outer edges of the dock but these usually have bolts projecting from the wooden surfaces outwards and upwards of six to eight inches. The projections not only pose a safety hazard but again are subject to degradation due to salt and brackish water.

A system is needed in the marina industry to restore degraded dock freeboard and/or to provide an increased load-bearing capacity for the dock to accommodate additional structures.

BRIEF SUMMARY OF THE INVENTION

The present invention provides a dock floatation system for rehabilitating a concrete dock that has lost freeboard and/or providing an increased load-bearing capacity for the dock. The dock floatation system is shaped to fit existing docks by a series of projections and/or flanges depending from floats of the dock floatation system. The inherent buoyancy of the dock floatation system and its shape-fit secure the dock floatation system to the concrete dock without requiring mechanical attachments. Moreover, the dock floatation system attaches to a submerged portion of the dock in a manner that prevents prop wash, current, wind, wave, weather phenomena and other external forces or actions from interfering with the connection of the dock floatation system and the dock.

The component parts of the dock floatation system are simple and economical to manufacture, assemble and use. Other advantages of the invention will be apparent from the following description and the attached drawings or can be learned through practice of the invention.

Generally, the dock floatation system of the present invention mates underwater in one or more indentations in an underside of a concrete dock. The dock floatation system generally includes a float that is shape-fitted to the indentations the dock. The float has a predetermined buoyancy that cooperates with the overall shape-fit of the dock floatation system to hold the dock floatation system securely to the dock.

In one aspect of the invention, a dock floatation system is provided with a key float having a key float body and an interlocking key depending from the key float body. The dock floatation system also includes a terminal float with a terminal float body and a plug disposed on the terminal float body. A perimeter is defined about the plug. The interlocking key of the key float body overlaps the perimeter of the terminal float body such that the interlocking key is disposed adjacent the plug to interlock the key float and the terminal float together. The key and terminal floats urge the interlocking key and the plug into a submerged indentation of a dock to retain the key and terminal floats against the dock and to stabilize the key and terminal floats from an external force such as wave action, wind, current, tides, propeller ("prop") wash and any combination of these forces.

The key and terminal floats in this aspect are made with a buoyant material such as an expanded polystyrene material. Additionally, a shell such as polyethylene, polypropylene, polyvinyl chloride, rubber, fiberglass, nylon, polyoxymethylene, polyetheretherketone or wood is used to shield and protect the buoyant material.

Each of the key and terminal floats exhibit 50 to 75 pounds per square foot of buoyant lift and nest in the indentation of the dock. The interlocking key and the plug can seal the indentation from marine life and stabilize the key and terminal floats from the external forces described above.

In another aspect of the invention, a dock floatation system is provided for a concrete dock. The dock floatation system includes a float having a body and at least two opposing flanges depending from the body. The float has an inherent buoyancy, which urges the flanges to overlap respective outer edges of a submerged dock face. The flanges and the buoyancy of the float cooperate to retain the float against the dock face and to stabilize the float against external forces similar to those noted above. Also similar to the previous embodiment, the buoyancy of the float in this aspect provides 50 to 75 pounds per square foot of lift.

Each of the flanges in this aspect of the invention depends from a face of the body of the float from 45 to 75 degrees to lock the float in position against the outer edges of the submerged dock face. Each of the flanges opposes movement by the other opposing flange away from the respective outer edges of the submerged dock face.

In yet another aspect of the invention, a method for installing a dock floatation system is provided. Steps of the method include: providing a float having means for retaining the float against a submerged portion of a dock; positioning the float with a float placement device; submerging the float proximate the dock with the float placement device; and placing the float against the submerged portion of the dock with the float placement device, the float having a buoyancy configured to increase freeboard of the dock. The means for retaining the float can be opposing flanges for gripping a submerged outer edge of the dock or keys and plugs disposed on an upper surface of the float for insertion in an underside indentation of the dock.

BRIEF DESCRIPTION OF THE DRAWINGS

The above and other aspects and advantages of the present invention are apparent from the detailed description below in combination with the drawings, in which.

DETAILED DESCRIPTION OF THE DRAWINGS

Figure 1:
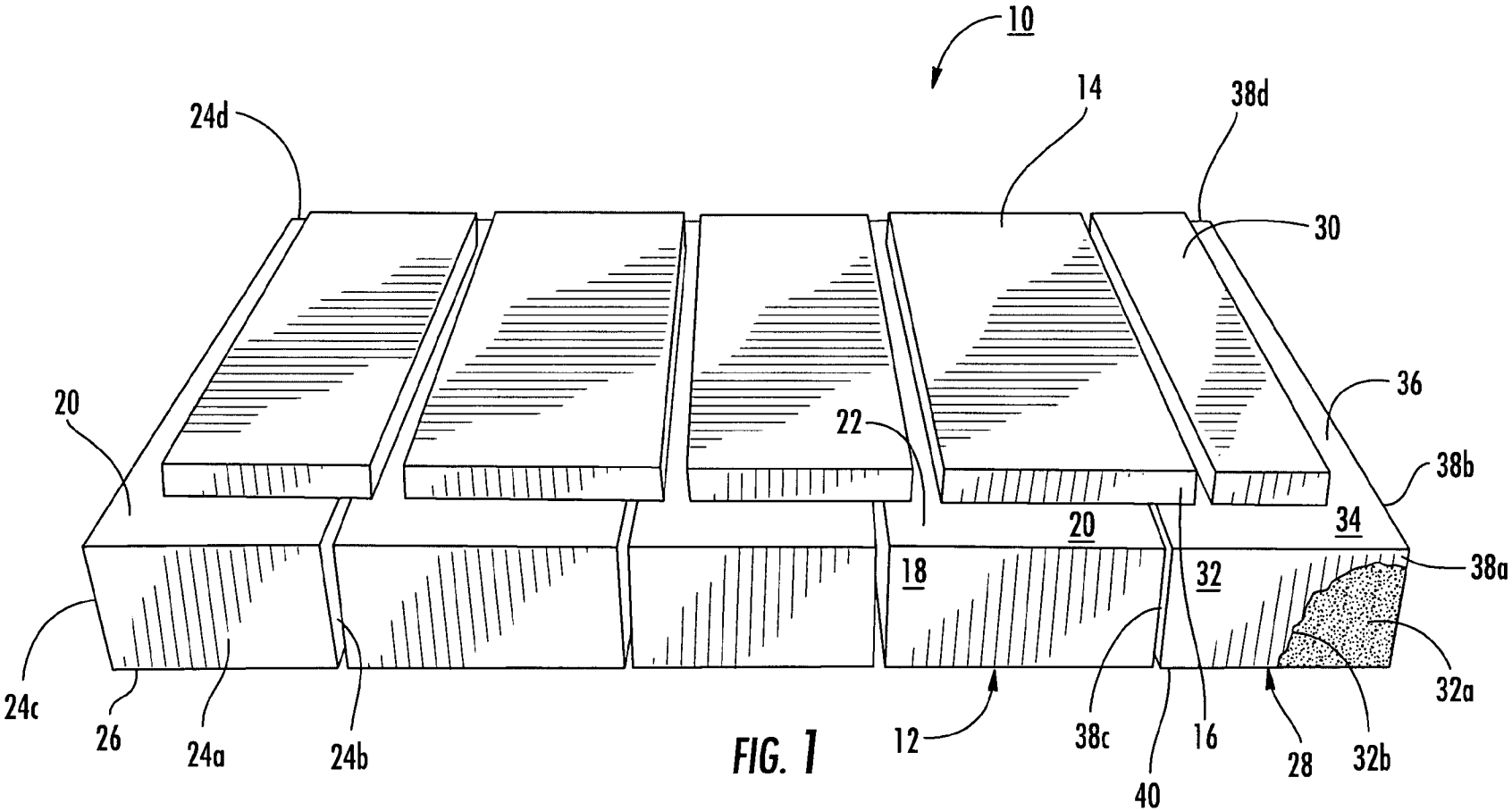
FIG. 1 is a perspective view of a dock floatation system according to an aspect of the present invention.

Detailed reference will now be made to the drawings in which examples embodying the present invention are shown. The detailed description uses numerical and letter designations to refer to features of the drawings. Like or similar designations of the drawings and description have been used to refer to like or similar parts of the invention.

The drawings and detailed description provide a full and detailed written description of the invention and of the manner and process of making and using it, so as to enable one skilled in the pertinent art to make and use it, as well as the best mode of carrying out the invention. However, the examples set forth in the drawings and detailed description are provided by way of explanation of the invention and are not meant as limitations of the invention. The present invention thus includes any modifications and variations of the following examples as come within the scope of the appended claims and their equivalents.

A dock floatation system is broadly embodied in FIGS. 1–6. In general, the dock floatation system refurbishes a concrete dock D that is losing freeboard F due to deterioration of buoyant material B in the dock D. Alternatively or additionally, the dock floatation system increases a load-bearing capacity of the dock D in order to accommodate additional weight of subsequently added structures.

With particular reference to FIG. 1, a dock floatation system is generally designated by the reference numeral 10. The dock floatation system 10 includes at least one key float 12 and a terminal float 28. The key float 12 has an interlock or interlocking key 14 disposed on a float body 18. The key 14 includes a ledge or overhanging lip 16 disposed on a top surface 20 of the float body 18. The lip 16 extends away from or overhangs at least a portion of a perimeter 22 of the top surface 20. Also shown, the exemplary float body 18 has four sides 24*a*–*d* and a bottom 26. As will be described in further detail below, the lip 16 can extend across any portion of the perimeter 22, even including all sides of the float body 18 such that no perimeter 22 is exposed.

FIG. 1 also shows the terminal float 28 having a fill key or plug 30 disposed on a terminal float body 32. The terminal float body 32 has a top surface 34 on which the plug 30 is disposed to define a perimeter 36 about the top surface 34. Similar to the float body 18 of the key float 12, the terminal float body 32 of the terminal float 28 has four sides 38*a*–*d* and a bottom 40.

Also shown in FIG. 1, the terminal float body 32 is partially cut away to reveal a polystyrene fill 32*a* within the terminal float body 32. As discussed below, the polystyrene fill 32*a* imparts buoyancy to the terminal float 28. Also in this example, a high-density polyethylene (HDPE) coating or shell 32*b* houses the polystyrene fill 32*a*. The shell 32*b* can be made of polyethylene, polypropylene, polyvinyl chloride, rubber, fiberglass, wood, nylon, polyoxymethylene; i.e., acetyl plastic (POM), polyetheretherketone (PEEK), or any material suitable for covering and protecting the polystyrene fill 32*a*. It will be appreciated that similar polystyrene fill and shell materials as found in the terminal float body 32 also form the terminal float 28.

The key float 12 and the terminal float 28 each exert an average lift (or load-bearing capacity) of about 50 to 75 per square foot, more particularly about 60 pounds per square foot, due to the polystyrene fill introduced above. In this example, the key float 12 is seven feet by eighteen inches by eight inches; thus, the key float 12 provides approximately seven hundred pounds of lift. Those skilled in the art will appreciate that lift of the key float 12 can be adjusted by modifying dimensions of the key float 12, or by using more or less buoyant material such as the polystyrene fill, or by using a material having more or less buoyancy, or by using any combination of these factors. Those skilled in the art will further appreciate that lift of the terminal float 28 can likewise be adjusted upwards or downwards. It will also be appreciated by those skilled in the art that the exemplary key and terminal floats 12, 28, which are shaped rectangularly in FIG. 1, can be square-shaped, octagonal-shaped or shaped otherwise to fit any dock D. In particular, the key 14 and the plug 30 can be shaped to fit any indentation under the dock D.

FIG. 1 also shows one of the key floats 12 placed against another of the key floats 12 and/or the terminal float 28 in which the lip 16 slides over and seats against a perimeter 22 of another key float 12 or a perimeter 36 of the terminal float 28 due to the seven hundred pounds or so of lift provided by the under dock floatation system 10. When the under dock floatation system 10 is in place—approximately two to three feet under the surface of the water—under a concrete dock D, the interlocking arrangement described above holds the under dock floatation system 10 together.

Figure 2:
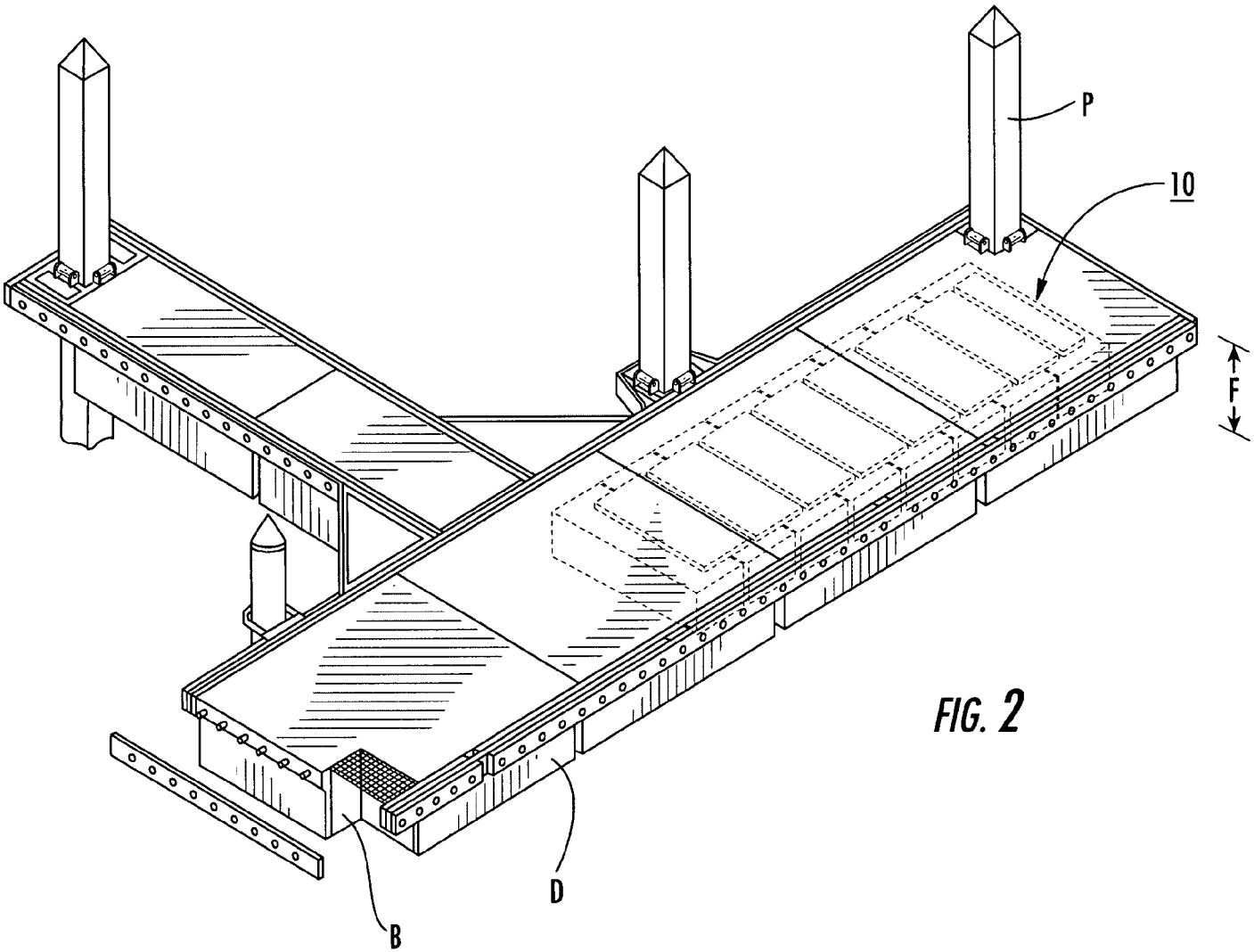
FIG. 2 is a perspective view of the dock floatation system as in FIG. 1 shown installed in phantom under a concrete dock.
Figure 3:
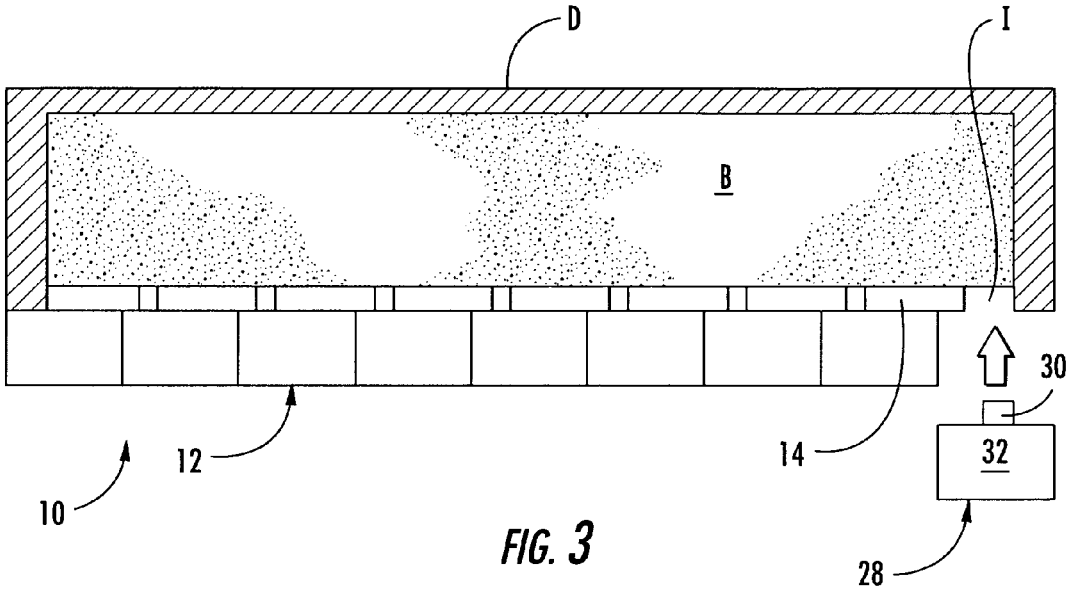
FIG. 3 is an elevational view of the dock and the dock floatation system as in FIG. 2 showing a step in a method of positioning the dock floatation system with the dock.

FIGS. 2 and 3 show the under dock floatation system 10 disposed in an indentation I of the dock D. The dock D is shown partially cut away to reveal a foam or floatation material B, which may be similar to the polystyrene fill 18*a* of the terminal float 28. The indentation I may have been formed in the floatation material B due to molding processes. The exposed floatation material B can deteriorate over time due to exposure to wind and wave action, pollutants in water, marine life and the like. For example, marine life tends to burrow into the floatation material B and "eat away" at the floatation material B, which results in a loss of freeboard F. The under dock floatation system 10 is therefore positioned and projected into the indentation I that has been exacerbated by the marine life or other underwater conditions.

FIG. 3 particularly shows the interlock key 14 and the plug 30 of the under dock floatation system 10 placed in the indentation I of the dock D. The key 14 and plug 30 are dimensioned so as to substantially seal the indentation I; i.e., the under dock floatation system 10 seals the deteriorating floatation material B from further contact by underwater elements or marine life. As noted, those skilled in the art will be appreciate that the size and shape of the key 14 and the plug 30 can be modified to complement a variety of indentations. It will be further appreciated that the dock floatation system 10 can terminate on both ends with terminal floats 28 to accommodate a specific indentation. Thus, those skilled in the art will appreciate that an additional lip (not shown) can extend opposite the lip 16 of the key float 12 to sandwich the key float 12 between two terminal floats 28.

As introduced above, the lift generated by the under dock floatation system 10 locks the key float 12 and the terminal float 28 into the dock D and rehabilitates the freeboard F of the dock D and/or increases freeboard F of the dock D. Also, as described below with respect to FIG. 6, an under dock floatation system 210 can be used in a targeted manner to counteract weight added to a portion of the dock D.

Figure 4:
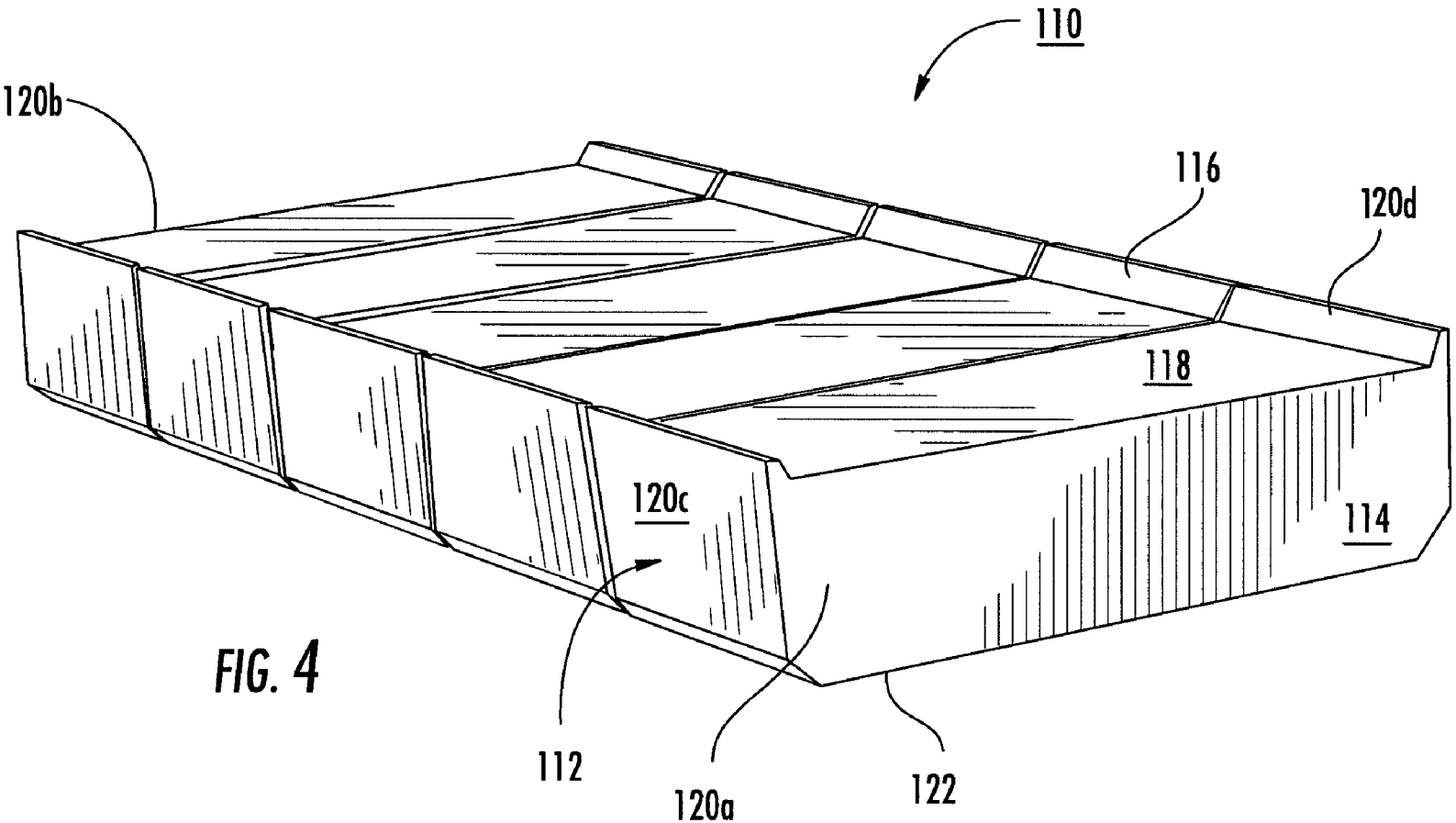
FIG. 4 is a perspective view of a dock floatation system according to another aspect of the present invention.
Figure 5:
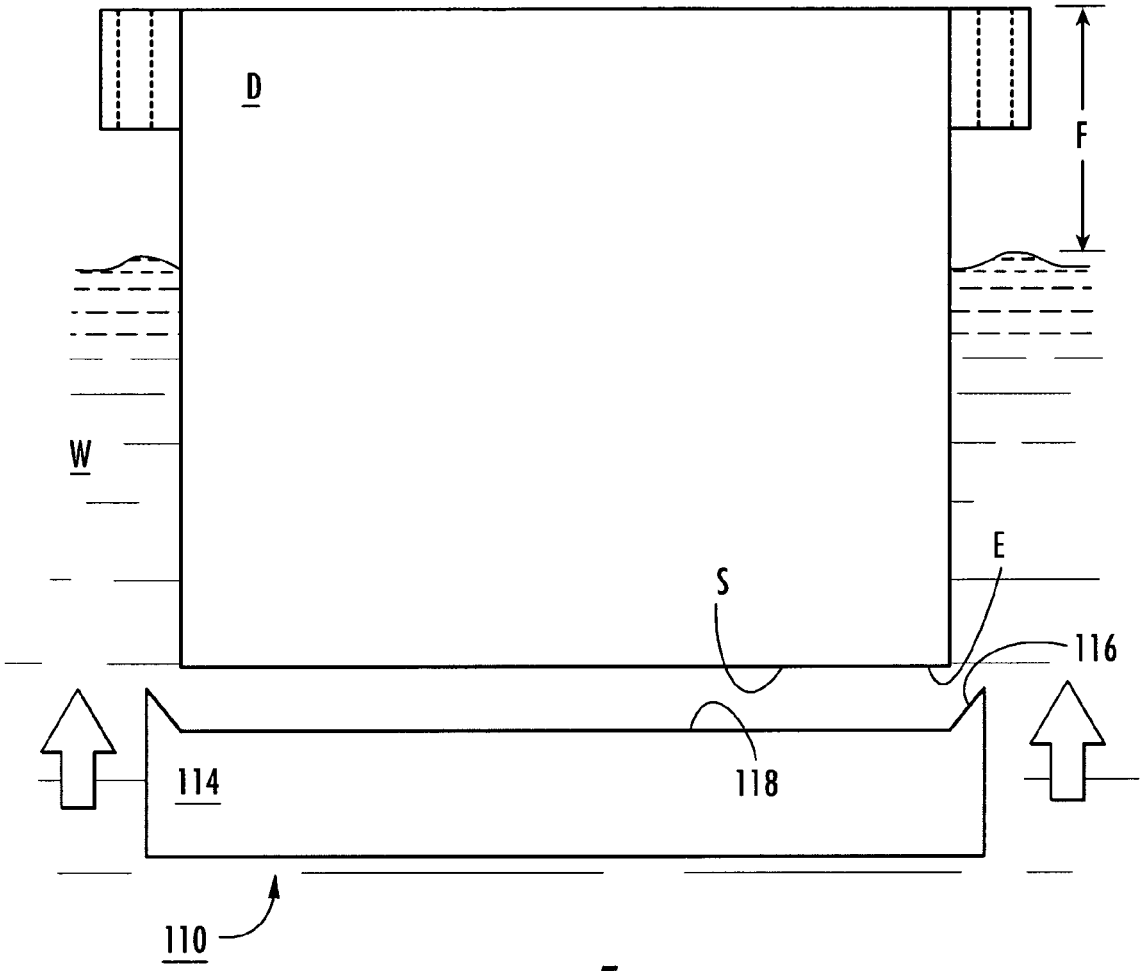
FIG. 5 is an end view of the dock floatation system as in FIG. 4 showing a step in a method of positioning the dock floatation system with a dock.

With reference to FIGS. 4 and 5, an alternative arrangement is shown for an under dock floatation system 110 for use with a dock D that is losing freeboard F due to age, weather exposure, added weight or the like as discussed above. In particular, the under dock floatation system 110 is used for the dock D having a solid, concrete bottom or surface S instead of exposed floatation material B as described above. In this aspect of the invention, the under dock floatation system 110 includes a flange float 112 having a body 114 with one or more flanges 116 depending therefrom. Similar to the foregoing embodiment, the flange float 112 has a top surface or face 118, four sides 120*a–d*, and a bottom 122. Also similar to the foregoing embodiment, the under dock floatation system 110 exhibits an exemplary rectangular shape but can be square-shaped, octagonal-shaped or made in variety of shapes to accommodate customer requirements or dock arrangements. Other components of the present embodiment such as fill material and the shell forming the flange float 112 are also similar to the foregoing embodiment and reference is made thereto to appreciate these aspects of the invention.

With particular reference to FIG. 5, a method of using the under dock floatation system 110 is shown. As shown, the under dock floatation system 110 is submerged beneath the surface S of the dock D and floated against the submerged underside S of the dock D. The inherent buoyancy of the under dock floatation system 110 of seven hundred pounds or more as previously described lifts the dock D and reestablishes lost freeboard F.

More particularly, the under dock floatation system 110 in FIG. 5 shape-fits to the dock D and nests against the underside S. While the dock D regains freeboard F and/or increases its weight bearing capacity, the flanges 116, which angle away from the face 118 of the body from about 45 to 75 degrees, embrace or grip submerged outer edges E of the dock D. Each of the flanges 116 act against each other to prevent one or the other of the flanges 116 from sliding away and out from under the dock D. Moreover, the flanges 116 nest against the dock edges E from two to three feet below a water surface WS. Thus, the inherent buoyancy of the dock floatation system 110, the shape-fitted flanges 116 and their underwater placement depth prevent the under dock floatation system 110 from washing away from the dock D due to prop wash, current, tide, wave action and the like.

Similar to the foregoing embodiment, the under dock floatation system 110 shown in FIGS. 4 and 5 does not use lag bolts or other mechanical attachments that are subject to degradation over time due to exposure to salt or brackish water, marine life, and the like. Therefore, the under dock floatation system 110 is durable and weather resistant and does not attach to the dock D in a damaging manner or by way of devices that are subject to deterioration. Furthermore, since the flanges 116 are disposed two to three feet below the water surface WS to reduce effects of prop wash and wave action as described above, the flanges 116 also do not pose a hazard to those traversing the dock D above.

Figure 6:
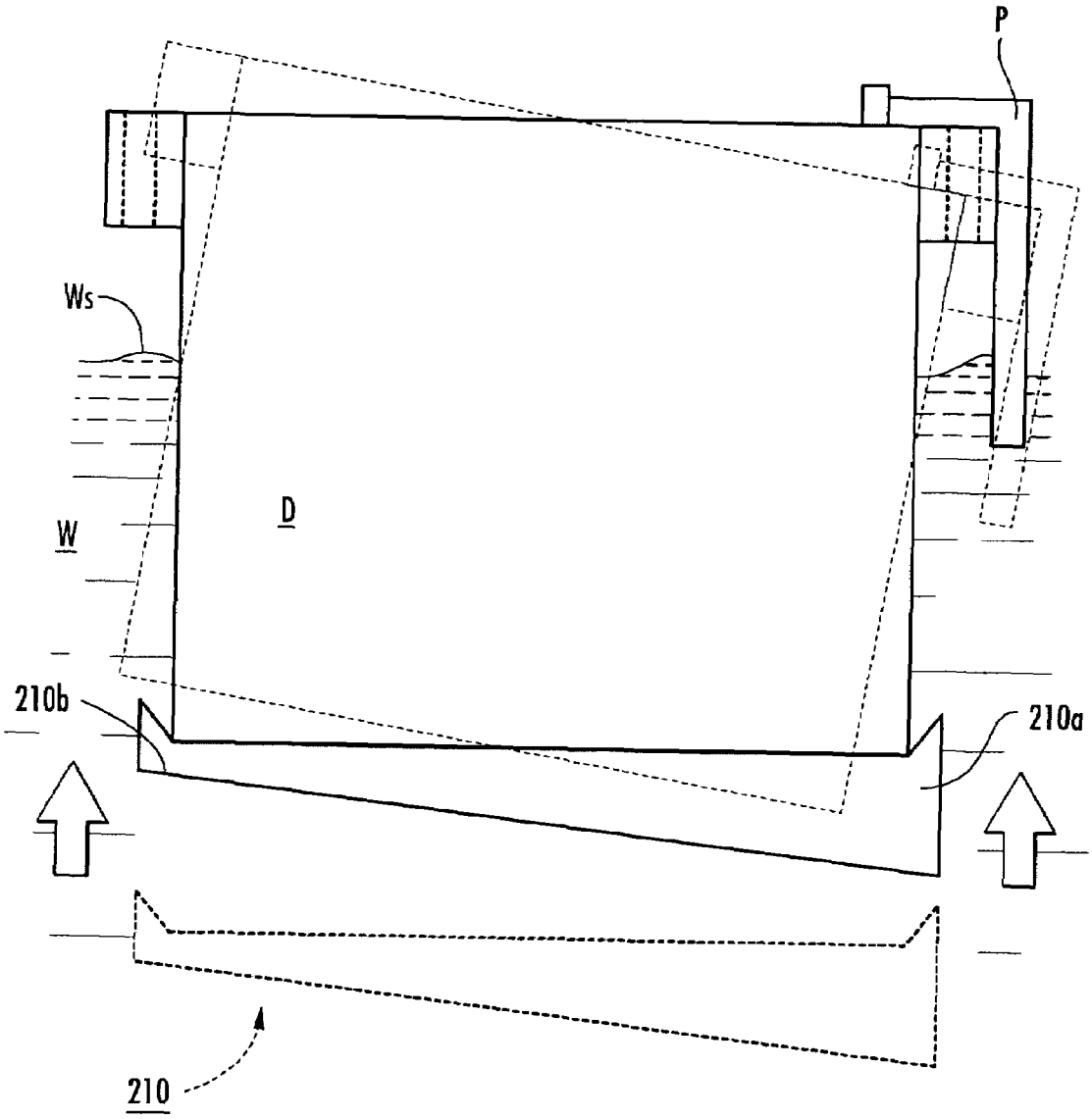
FIG. 6 is an end view of a dock floatation system according to another aspect of the invention showing a step in a method of positioning the dock floatation system to level a load-twisted dock.

In yet another aspect of the invention, FIG. 6 shows an under dock floatation system generally designated by the numeral 210. The under dock floatation system 210 is in some ways similar to the embodiment shown in FIGS. 4 and 5. Thus, reference is made to the foregoing embodiment for similar components and elements for the sake of providing an enabling disclosure.

The under dock floatation system 210 of FIG. 6 is shaped to level a dock D that has twisted due to an increased load on a portion of the dock D. As shown, a fire main pipe P, typically made of iron, steel or other metal, has been added to a side of the dock D to access the water W in order to provide a source of water to put out fires on the dock D or boats docked alongside. The fire main pipe P is naturally heavy due to its metallic composition and/or its large diameter capacity and thus tends to twist the dock D as shown in phantom in FIG. 6.

Thus, the under dock floatation system 210 in FIG. 6 is different from the foregoing embodiment primarily in that under dock floatation system 210 is formed in an irregular shape to level a twisted dock. In other words, the relatively regular shape of the previous embodiment would exert equal buoyancy across the underside S of the dock D, which would not remedy its irregular load and level the dock. Therefore, in this example, a side 210*a* of the under dock floatation system 210 is larger or thicker than its opposing side 210*b*. Accordingly, the under dock floatation system 210 is positioned under the twisted dock D with the thicker side 210*a* placed under a side of the dock D with the newly installed fire main pipe P. In this manner, the thicker side 210*a* of the under dock floatation system 210, which has a greater buoyancy than its opposing side 210*b*, lifts the fire main pipe P side of the dock D such that the dock D is leveled.

Those skilled in the art will appreciate that the under dock floatation system 210 shown FIG. 6 utilizes shape fit flanges 216 similar to the embodiment described above with respect to FIG. 4. However, it will be appreciated that the irregular shaped under dock floatation system 210 can utilize the interlocking key and plug system as described above with respect to FIG. 1 to level a twisted dock D with an exposed indentation I as described above.

While preferred embodiments of the invention have been shown and described, those skilled in the art will recognize that other changes and modifications may be made to the foregoing examples without departing from the scope and spirit of the invention. For instance, numerical references size and buoyancy characteristics of the exemplary floats described herein can be changed to accommodate various dock sizes; e.g., the floats may be increased in length, width or depth and densities of polystyrene and/or different fill materials can be changed or used to increased buoyancy of the floats. It is intended to claim all such changes and modifications as fall within the scope of the appended claims and their equivalents. Moreover, references herein to "top," "bottom," "upward," "upper," "higher," "lower," "downward," "descending," "ascending," "side," "first," and "second" structures, elements, designations, geometries and the like are intended solely for purposes of providing an enabling disclosure and in no way suggest limitations regarding the operative orientation or order of the exemplary embodiments or any components thereof.

That which is claimed:

1. A dock floatation system comprising:

a key float having a key float body and an interlocking key depending from the key float body; and a terminal float with a terminal float body and a plug disposed on the terminal float body, a perimeter defined about the plug, the interlocking key of the key float body configured to overlap the perimeter of the terminal float body such that the interlocking key is disposed adjacent the plug to interlock the key float and the terminal float together, the key and terminal floats configured to urge the interlocking key and the plug into a submerged indentation of a dock to retain the key and terminal floats against the dock and to stabilize the key and terminal floats from an external force.

2. The dock floatation system as in claim 1, wherein the key and terminal floats are made with a buoyant material.

3. The dock floatation system as in claim 2, wherein the buoyant material is an expanded polystyrene material.

4. The dock floatation system as in claim 2, further comprising a shell configured to shield the buoyant material.

5. The dock floatation system as in claim 4, wherein the shell is made from one of polyethylene, polyoxymethylene, polyetheretherketone, polypropylene, polyvinyl chloride, rubber, fiberglass, wood, or nylon.

6. The dock floatation system as in claim 1, wherein each of the key and terminal floats exhibit 50 to 75 pounds per square foot of buoyant lift.

7. The dock floatation system as in claim 1, wherein the interlocking key and the plug nest in the indentation of the dock.

8. The dock floatation system as in claim 7, wherein the interlocking key and the plug cooperate to seal the indentation from marine life.

9. The dock floatation system as in claim 1, wherein the interlocking key and the plug nest in the indentation to stabilize the key and terminal floats from the external force, the external force selected from the group consisting of wave action, wind, current, tides, prop wash and combinations thereof.

10. A dock floatation system for a dock, the dock floatation system comprising:

a float having a body and at least two opposing flanges depending from the body, the float having a buoyancy urging the flanges to seat against respective outer edges of a submerged dock face of a dock, the float being shape-fitted to the submerged dock face such that the flanges and the buoyancy cooperate to retain the float against the dock face and stabilize the float against an external force, the float being configured to buoy the dock.

11. The dock floatation system as in claim 10, wherein the buoyancy of the float is 50 to 75 pounds per square foot of lift.

12. The dock floatation system as in claim 10, wherein each of the flanges oppose movement by the other flange away from the respective outer edges.

13. The dock floatation system as in claim 10, wherein each of the flanges depend from a face of the body from 45 to 75 degrees.

14. The dock floatation system as in claim 10, wherein the float is submerged away from the external force, the external force selected from the group consisting of wave action, wind, current, tides, prop wash and combinations thereof.

15. A method for installing a dock floatation system, the method comprising the steps of:

providing a float having means for retaining the float against a submerged portion of a dock, the float being shape-fitted to the submersed portion of the dock;

submerging the float proximate the dock with a float placement device; and placing the float against the submerged portion of the dock with the float placement device, the float having a buoyancy configured to seat the float against the dock to provide freeboard to the dock.

16. The method as in claim 15, wherein the float has 50 to 75 pounds per square foot of buoyant lift.

17. The method as in claim 15, wherein the means for retaining the float are an interlocking key and a plug configured for insertion in a submerged indentation of the dock.

18. The method as in claim 15, wherein the means for retaining the float are opposing flanges configured for gripping a submerged outer edge of the dock.

19. The method as in claim 15, further comprising the step of positioning the submerged float against the submerged portion of the dock.

20. The method as in claim 15, further comprising the steps of providing another float and positioning the another float adjacent the float.

* * * * *

UNITED STATES PATENT AND TRADEMARK OFFICE

CERTIFICATE OF CORRECTION

PATENT NO. : 7,128,015 B1
APPLICATION NO. : 11/014644
DATED : October 31, 2006
INVENTOR(S) : Rogerson It is certified that error appears in the above-identified patent and that said Letters Patent is hereby corrected as shown below:

Column 8, line 35, please delete “submersed” and insert --submerged--.

Signed and Sealed this

Second Day of January, 2007

JON W. DUDAS
*Director of the United States Patent and Trademark Office*